US009368079B2

(12) United States Patent
Chen et al.

(10) Patent No.: US 9,368,079 B2
(45) Date of Patent: Jun. 14, 2016

(54) DISPLAY DEVICE AND A METHOD FOR DRIVING THE SAME

(71) Applicant: Shenzhen China Star Optoelectronics Technology Co., Ltd., Guangdong (CN)

(72) Inventors: Li-Yi Chen, Guangdong (CN); Yu-Yeh Chen, Guangdong (CN); Wenqin Zhao, Guangdong (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 70 days.

(21) Appl. No.: 14/404,461

(22) PCT Filed: Jul. 24, 2014

(86) PCT No.: PCT/CN2014/082926

§ 371 (c)(1),
(2) Date: Nov. 27, 2014

(87) PCT Pub. No.: WO2015/184678

PCT Pub. Date: Dec. 10, 2015

(65) Prior Publication Data

US 2015/0356935 A1 Dec. 10, 2015

(30) Foreign Application Priority Data

Jun. 7, 2014 (CN) ..... 2014 1 0250990

(51) Int. Cl.
*G09G 5/00* (2006.01)
*G09G 3/36* (2006.01)

(52) U.S. Cl.
CPC ..... *G09G 3/3614* (2013.01); *G09G 3/3674* (2013.01); *G09G 3/3685* (2013.01); *G09G 2310/0213* (2013.01); *G09G 2310/0224* (2013.01); *G09G 2330/021* (2013.01)

(58) Field of Classification Search
CPC ..... G09G 3/3614; G09G 3/3674; G09G 2310/0213; G09G 2310/0224; G09G 2330/021; G09G 3/3685
USPC ..... 345/87–100, 204–215
See application file for complete search history.

(56) References Cited

U.S. PATENT DOCUMENTS 7,088,349 B2 * 8/2006 Iisaka ..... G09G 3/3648 315/169.1
7,408,527 B2 * 8/2008 Slobodin ..... G09G 3/3413 345/204
7,876,299 B2 * 1/2011 Bolotski ..... G09G 3/2081 345/690

* cited by examiner

*Primary Examiner* — Vijay Shankar

(57) ABSTRACT

A method for driving a display device is disclosed. Display images of one frame are divided into detection regions; pixel polarity arrangements of each detection region are determined, and according to the determined result a data driving circuit selects a corresponding scanning method to drive the display device. The data driving circuit adopts an interlaced-to-progress scanning conversion method to drive the display device, so as to ensure that there are no data circuits in a loaded state, thereby reducing the power consumption of the display device.

16 Claims, 4 Drawing Sheets

| | | |
|---|---|---|
| + | + | + |
| - | - | - |
| + | + | + |
| - | - | - |
| + | + | + |
| - | - | - |
| + | + | + |
| - | - | - |

FIG. 1

| | | |
|---|---|---|
| + | + | + |
| + | + | + |
| - | - | - |
| - | - | - |
| + | + | + |
| + | + | + |
| - | - | - |
| - | - | - |

FIG. 2

| | | |
|---|---|---|
| - | - | - |
| + | + | + |
| - | - | - |
| + | + | + |
| - | - | - |
| + | + | + |
| - | - | - |
| + | + | + |

FIG. 4B

| | | |
|---|---|---|
| + | + | + |
| + | + | + |
| - | - | - |
| - | - | - |
| + | + | + |
| + | + | + |
| - | - | - |
| - | - | - |

FIG. 5A

DISPLAY DEVICE AND A METHOD FOR DRIVING THE SAME

RELATED APPLICATIONS

This application is a National Phase of PCT Patent Application No. PCT/CN2014/082926 having International filing date of Jul. 24, 2014, which claims the benefit of priority of Chinese Patent Application No. 201410250990.4 filed on Jun. 7, 2014. The contents of the above applications are all incorporated by reference as if fully set forth herein in their entirety.

FIELD OF THE INVENTION

The present invention relates to the technical field of displays, and in particular it relates to a driving method for a display device and a driving apparatus.

BACKGROUND OF THE INVENTION

Currently, thin film transistor (TFT) display devices offer higher resolutions and larger sizes, and frame rate are moving from 60 Hz to 120 Hz whilst increasing communication bandwidth, so that the power consumption of TFT display devices is increasing. A first pixel polarity arrangement is shown in FIG. 1, since the polarity between adjacent rows is opposite, a conventional progressive scanning method will lead to high power consumption, and therefore source IC (data driving circuit) will overload. As shown in FIG. 2, a second pixel polarity arrangement which has two rows as a unit of the same polarity, and adjacent units have opposite polarity; even by adopting an interlaced scanning method, the power consumption will also be very high, and source ICs will overload as well.

Since there are a plurality of source ICs in a liquid crystal display device, each of the source IC drives pixels in a certain region. When the first pixel polar arrangement and the second pixel polarity arrangement are respectively present in different regions driven by different source ICs and, regardless of whether the progressive scanning method or the interlace scanning method is adopted, at least one source IC will overload, so that the source IC will be heated, and the drive circuit will be burn out.

SUMMARY OF THE INVENTION

An objective of the present invention is to provide a driving apparatus and a driving method of a display device in order to solve the conventional problem that a first pixel polarity arrangement and a second pixel polarity arrangement are respectively present in different regions driven by different source ICs and, regardless of whether a progressive scanning method or an interlace scanning method is adopted, at least one source IC will overload, so that the source IC will be heated, and the drive circuit will be burn out.

The present invention is implemented by a method for driving a display device, the method comprises steps of: dividing display images of one frame into detection regions; determining whether each of the detection regions includes a first pixel polarity arrangement or a second pixel polarity arrangement; wherein, the first pixel polarity arrangement and the second pixel polarity arrangement are different; when it is determined that each of the detection regions does not include the first pixel polarity arrangement, then a data driving circuit drives the display device in a progressive scanning method; when it is determined that at least one detection region includes the first pixel polarity arrangement but the other detection regions do not include the second pixel polarity arrangement, then the data driving circuit drives the display device in an interlaced scanning method; when it is determined that at least one detection region includes the first pixel polarity arrangement and at least one detection regions includes the second pixel polarity arrangement, then the data driving circuit drives the display in an interlaced-to-progressive scanning conversion method.

Another objective of the present invention is to provide a method for driving a display device, the method comprises steps of: dividing display images of one frame into detection regions; determining pixel polarity arrangements of each detection region; selecting a corresponding scanning method according to the determined result to drive the display device via a data driving circuit.

The step of determining pixel polarity arrangements of each detection regions comprises: determining whether each of the detection regions includes a first pixel polarity arrangement or a second pixel polarity arrangement.

Steps for determining whether the detection region includes the first pixel polarity arrangement are: presetting a first threshold voltage; if an absolute value of a voltage obtained by a voltage of row N+1 minus a voltage of row N is greater than the first threshold value, and an absolute value of the voltage obtained by the voltage of row N+1 minus a voltage of row N+2 is greater than the first threshold value, then the detection region includes the first pixel polarity arrangement.

Steps for determining whether the detection region includes the second pixel polarity arrangement are: presetting a second threshold voltage; if an absolute value of the voltage obtained by a voltage of row N+1 minus a voltage of row N is greater than the second threshold value, and an absolute value of voltage obtained by the voltage of row N+1 minus a voltage of row N+2 is less than the second threshold value; or if an absolute value of voltage obtained by a voltage of row N+1 minus a voltage of row N is less than the second threshold value, and an absolute value of voltage obtained by the voltage of row N+1 minus a voltage of row N+2 is greater than the second threshold value, then the detection region includes the second pixel polarity arrangement.

The step of selecting a corresponding scanning method according to the determined result to drive the display device via a data driving circuit comprises: when it is determined that each of the detection regions does not include the first pixel polarity arrangement, then the data driving circuit drives the display device in a progressive scanning method; when it is determined that at least one detection region includes the first pixel polarity arrangement but the other detection regions do not include the second pixel polarity arrangement, then the data driving circuit drives the display device in an interlace scanning method; when it is determined that at least one detection region includes the first pixel polarity arrangement and at least one detection regions includes the second pixel polarity arrangement, then the data driving circuit drives the display in an interlaced-to-progressive scanning conversion method.

The step in which it is determined that each of the detection regions does not include the first pixel polarity arrangement, then the data driving circuit drives the display device in a progressive scanning method comprise: when it is determined that each of the detection regions does not includes the first pixel polarity arrangement but at least one detection region includes the second pixel polarity arrangement, then the data driving circuit drives the display device in the progressive scanning method; or when it is determined that each of the detection regions does not include the first pixel polarity arrangement and the second pixel polarity arrangement, then the data driving circuit drives the display device in the progressive scanning method.

The first pixel polarity arrangement and the second pixel polarity arrangement are different. The first pixel polarity arrangement has opposite polarity between adjacent rows; the second pixel polarity arrangement has two lines as a unit of the same polarity, adjacent units have opposite polarity.

The other objective of the present invention is to provide a driving apparatus of a display device, the driving apparatus comprises: a dividing module, for dividing display images of one frame into detection regions; a determining module, for determining the pixel polarity arrangements of each detection region; and a driving module for driving the display device by selecting a corresponding scanning method according to the determined result.

The determining module is specifically for determining whether each of the detection regions includes a first pixel polarity arrangement or a second pixel polarity arrangement.

The determining module comprises a first determining module and a second determining module; where the first determining module is for determining whether each of the detection regions includes the first pixel polarity arrangement by: presetting a first threshold voltage; if an absolute value of a voltage obtained by a voltage of row N+1 minus a voltage of row N is greater than the first threshold value, and an absolute value of the voltage obtained by the voltage of row N+1 minus a voltage of row N+2 is greater than the first threshold value, then the detection region includes the first pixel polarity arrangement; the second determining module is for determining whether each of the detection regions includes the second pixel polarity arrangement by: presetting a second threshold voltage; if an absolute value of the voltage obtained by a voltage of row N+1 minus a voltage of row N is greater than the second threshold value, and an absolute value of the voltage obtained by the voltage of row N+1 minus a voltage of row N+2 is less than the second threshold value, then the detection region includes the second pixel polarity arrangement; or the second determining module is for determining whether each of the detection regions includes the second pixel polarity arrangement, comprising steps of: presetting a second threshold voltage; if an absolute value of the voltage obtained by a voltage of row N+1 minus a voltage of row N is less than the second threshold value, and an absolute value of the voltage obtained by the voltage of row N+1 minus a voltage of row N+2 is greater than the second threshold value, then the detection region includes the second pixel polarity arrangement.

The driving module is specifically for driving the display device in a progressive scanning method when it is determined that each of the detection regions does not include the first pixel polarity arrangement; when it is determined that at least one detection region includes the first pixel polarity arrangement, but the other detection regions do not include the second pixel polarity arrangement, then the data driving circuit drives the display in an interlaced scanning method; when it is determined that at least one region includes the first pixel polarity arrangement, and at least one detection region includes the second pixel polarity arrangement, then the data driving circuit drives the display in an interlaced-to-progressive scanning conversion method.

The driving module is further for driving the display device in the progressive scanning method when it is determined that each of the detection regions does not include the first pixel polarity arrangement, but at least one detection region includes the second pixel polarity arrangement; or it is for driving the display device in the progressive scanning method when it is determined that each of the detection regions does not include the first pixel polarity arrangement and the second pixel polarity arrangement.

In the present invention, firstly, the display images of one frame are divided into several detection regions. The pixel polarity arrangement of the detection region is then determined; when at least one detection region of the detection regions includes the first pixel polarity arrangement and at least one detection region includes the second pixel polarity arrangement, the data driving circuit adopts the interlaced-to-progress scanning conversion method to drive the display device. The progressive scanning method and interlaced scanning method are each held for half of the time, so as to ensure that the data driving circuits are not in a reloaded state. Thus, the power consumption of the display device can be reduced, not only can power be saved, but also the heat generation can be reduced and the product durability can be improved.

BRIEF DESCRIPTION OF THE DRAWINGS

FIG. 1 is a schematic diagram of a first pixel polarity arrangement provided by a conventional art;

FIG. 2 is a schematic diagram of a second pixel polarity arrangement provided by a conventional art;

FIGS. 4A and 4B are schematic diagrams of a first pixel polarity arrangement provided by the present invention;

FIGS. 5A and 5B are schematic diagrams of a second pixel polarity arrangement provided by the present invention.

DETAILED DESCRIPTION OF THE PREFERRED EMBODIMENTS

In order to make the invention's purpose, technical solutions, and the advantages which are provided in the invention more clear and apparent, this invention will be described below in detail with respect to embodiments by referring to the accompanying drawings. It should be understood that the following description is intended to describe exemplary embodiments of the invention, and not to limit the invention.

In the embodiments of the present invention, a method to determine the pixel polarity arrangement in the detection region is: when at least one detection region of the detection regions includes a first pixel polarity arrangement, and at least one detection region includes a second pixel polarity arrangement, then a data driving circuit adopts an interlaced-to-progressive scanning conversion method to drive the display device; the progressive scanning method and interlaced scanning method are each held for half of the time, so as to ensure that no data driving circuit has been in an overloaded state. Thus, not only can power be saved, but the heat generated can also be reduced to improve the product durability.

Figure 3:
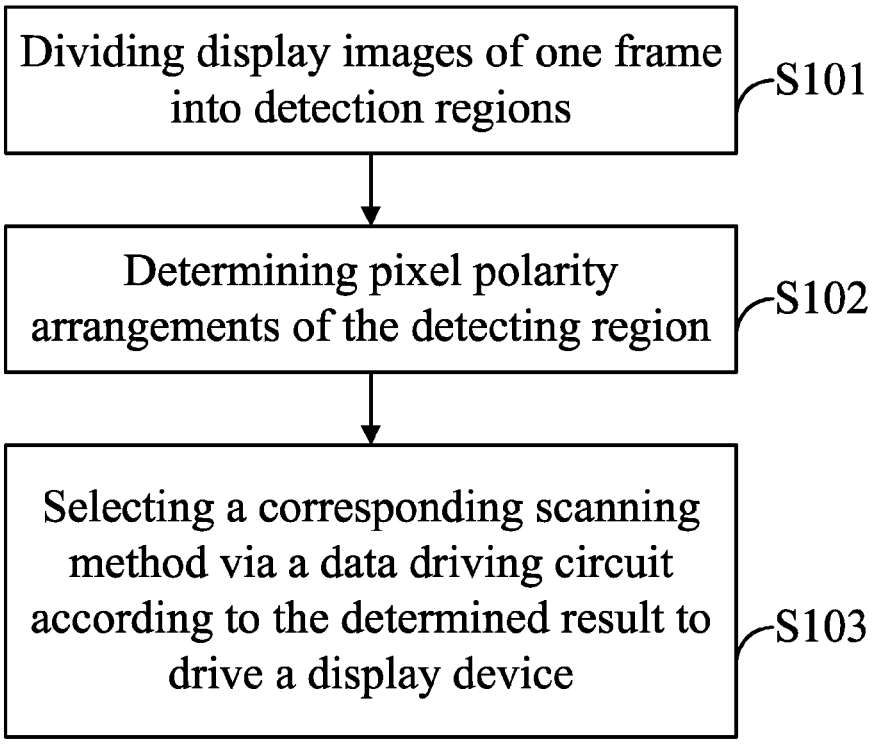
FIG. 3 is an implementation flow chart of a method for driving a display device provided by a preferred of the present invention.

FIG. 3 is an implementation flow chart of a method for driving a display device provided by a preferred of the present invention, comprising the steps of: step S101, dividing display images of one frame into detection regions. In one embodiment of the present invention, a data driving circuit drives pixels in one detection region, and divides the display images of one frame into several detection regions. In the present embodiment, the number of the detection regions is divided according to the number of the data driving circuits. The number of rows in one detection region can be 4 lines or more than 4 lines; for example, 4 lines, 8 lines, 9 lines, 10 lines, 100 lines, or maximum lines of one frame. The number of columns in the detection regions can be the number of columns driven by the data driving circuit.

In step S102, the pixel polarity arrangements in each of the detection regions are determined. In one embodiment of the present invention, step S102 specifically comprises: determining whether each of the detection regions includes a first pixel polarity arrangement or a second pixel polarity arrangement.

Steps for determining whether the detection region includes the first pixel polarity arrangement are: presetting a first threshold voltage; if an absolute value of a voltage obtained by a voltage of row N+1 minus a voltage of row N is greater than the first threshold value, and an absolute value of the voltage obtained by the voltage of row N+1 minus a voltage of row N+2 is greater than the first threshold value, then the detection region includes the first pixel polarity arrangement.

Take three adjacent rows for example, a method for determining whether the first pixel polarity arrangement is included is: |V line2-V line1|>Vh, and |V line2-V line3|>Vh, where Vh represents a preset threshold voltage. If the adjacent three rows are satisfied by the above formula, then it is determined the detection region includes the first pixel polarity arrangement. Specifically, take eight adjacent rows for example, the determine procedure must be taken separately for pixels of each three adjacent rows, such as determining pixels of the first, second, and third rows; the second, third, and fourth rows; the third, fourth, and fifth rows; the fifth, sixth, and seventh rows; or the sixth, seventh, and eighth rows. However, it should be understood that the determining procedure can also be taken separately for each four or five adjacent rows.

Preferably, in order to more precisely determine whether the detection region includes the first pixel polarity arrangement, the implementation steps are: presetting a pixel number threshold value; when the number of pixels arranged in the first pixel polarity arrangement is greater than the preset pixel number threshold value, then it is determined that the detection region includes the first pixel polarity arrangement.

Steps for determining whether the detection region includes the second pixel polarity arrangement are: presetting a second threshold voltage; if an absolute value of the voltage obtained by a voltage of row N+1 minus a voltage of row N is greater than the second threshold value, and an absolute value of the voltage obtained by the voltage of row N+1 minus a voltage of row N+2 is less than the second threshold value, then the detection region includes the second pixel polarity arrangement.

Another method for determining whether there includes the second pixel polarity arrangement is: if an absolute value of the voltage obtained by the voltage of row N+1 minus the voltage of row N is less than the second threshold value, and an absolute value of the voltage obtained by the voltage of row N+1 minus the voltage of row N+2 is greater than the second threshold value, then the detection region includes the second pixel polarity arrangement.

Take three adjacent rows for example, a method for determining whether the second pixel polarity arrangement is included is: |V line2-V line1|>Vh, and |V line2-V line3|<V1, or |V line2-V line1|<V1, and |V line2-V line3|>Vh, where V1 represents a preset threshold voltage. If the three adjacent rows are satisfied by the above formula, then it is determined that the detection region includes the second pixel polarity arrangement.

Preferably, in order to more precisely determine whether the detection region includes the second pixel polarity arrangement, the implementation steps are: presetting a pixel number threshold value; when the number of pixels arranged in the second pixel polarity arrangement is greater than the preset pixel number threshold value, then it is determined that the detection region includes the second pixel polarity arrangement.

In step S103, a corresponding scanning method is selected according to the determined result to drive the display device via a data driving circuit. In one embodiment of the present invention, step S103 is specifically: when it is determined that each of the detection regions does not include the first pixel polarity arrangement, then the data driving circuit drives the display device in the progressive scanning method; As one embodiment of the present invention, step S103 is specifically: when it is determined that each of the detection regions does not include the first pixel polarity arrangement, but at least one detection region includes the second pixel polarity arrangement, then the data driving circuit drives the display device in the progressive scanning method.

As another embodiment of the present invention, step S1031 specifically comprises: when it is determined that each of the detection regions does not include the first pixel polarity arrangement and the second pixel polarity arrangement, then the data driving circuit drives the display device in the progressive scanning method.

In step S1032, when it is determined that at least one detection region includes the first pixel polarity arrangement, but the other detection regions do not include the second pixel polarity arrangement, then the data driving circuit drives the display device in the interlaced scanning method.

In the embodiments of the present invention, the first pixel polarity arrangement and the second pixel polarity arrangement are different.

Figure 4A:
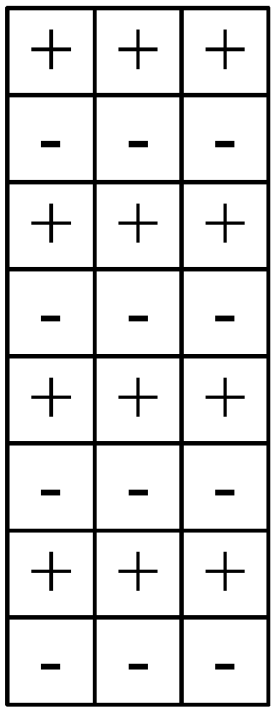
Figure 5B:
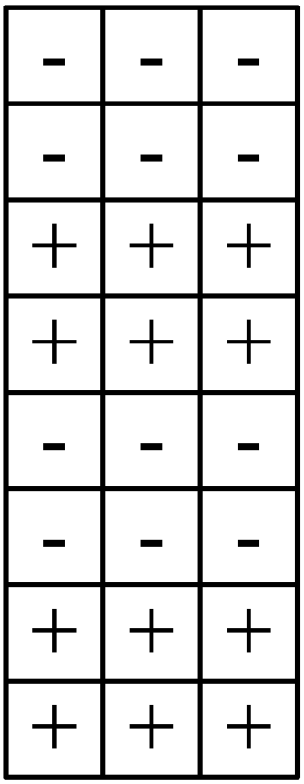

Preferably, the first pixel polarity arrangement has opposite polarity between adjacent rows; the second pixel polarity arrangement has two rows as a unit of the same polarity, adjacent units have opposite polarity, where the first pixel polarity arrangement is shown in FIGS. 4A and 4B. The pixel polarity of first row shown in FIG. 4A is positive, the pixel polarity of second row is negative, the pixel polarity of third row is positive, the pixel polarity of fourth row is negative, and so on; the pixel polarity of first row shown in FIG. 4B is negative, the pixel polarity of second row is positive, the pixel polarity of third row is negative, the pixel polarity of fourth row is positive, and so on. The second pixel polarity arrangement is shown in FIGS. 5A and 5B. The pixel polarity of first row, the third row, and the fourth row shown in FIG. 5A are negative, the pixel polarity of fifth row and the sixth row are positive, while the pixel polarity of the seventh row and the eighth row are negative, and so on; in FIG. 5B, the pixel polarity of first row and the second row are negative, the pixel polarity of third row and the fourth row are positive, the pixel polarity of the fifth row and the sixth row are negative, the pixel polarity of seventh row and the eighth row are positive, and so on.

In step S1033, when it is determined that at least one detection region includes the first pixel polarity arrangement, and at least one detection region includes the second pixel polarity arrangement, then the data driving circuit drives the display device in the interlaced-to progressive scanning conversion method.

In one embodiment of the present invention, there are many ways to process the interlaced scanning method, for example: 1-3-2-4-5-7-6-8 . . . ; 1-3-5-2-4-6-7-8 . . . ; 1-3-5-7-2-4-6-8 . . . , etc. However, it should be understood that, the interlaced scanning method is not limited by the above. Any modification, equivalent replacement, or improvement under the spirit and principles of the present invention should be included within the protection scope of the present invention.

For example, if there are two source ICs (data driving circuit), then the display image of one frame is divided into two detection regions, a detection region A and a detection region B, respectively. The maximum row number of the display image in one frame is 100 rows. Taking eight rows as the detection region for an example, if the detection region A includes the first pixel polarity arrangement, the detection region B includes the second pixel polarity arrangement, then the interlaced-to-progressive scanning conversion method is adopted to process the scan procedure, the progressive scanning method and interlaced scanning method are each held for half of the time. Thus, four rows adopt the progressive scanning method, and the other four rows adopt the interlaced scanning method.

For a further example, if there are two source ICs (data driving circuit), then the display image of one frame is divided into two detection regions, a detection region A and a detection region B, respectively. When the row number of the detection region is the maximum row number of the display image in one frame (such as 960 rows), if the detection region A includes the first pixel polarity arrangement, the detection region B includes the second pixel polarity arrangement, then the interlaced-to-progressive scanning conversion method is adopted to process the scan procedure; that is, the progressive scanning method and interlaced scanning method are each held for 480 rows of the scanning time. By adopting the display device driving method provided by the above embodiments, when at least one detection region of each region includes the first pixel polarity arrangement and at least one detection region includes the second pixel polarity arrangement, then the data driving circuit adopts the interlaced-to-progressive scanning conversion method to drive the display device; the progressive scanning method and interlaced scanning method are each held for half of the time, so as to ensure that the data driving circuits are not in a reloaded state. Thus, the power consumption of the display device can be reduced, not only can power be saved, but heat generation can also be reduced and the product durability can be improved.

Figure 6:
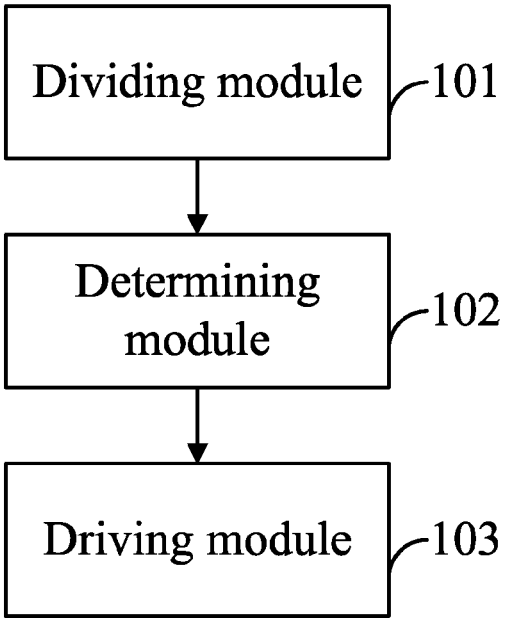
FIG. 6 is a schematic diagram of a driving apparatus structure in a display device provided by a preferred embodiment of the present invention.

FIG. 6 is a schematic diagram of a driving apparatus structure in a display device provided by a preferred embodiment of the present invention. For convenience, only the portion related to the embodiment of the present invention is shown. The driving apparatus of the display device comprises: a dividing module 101, a determining module 102, and a driving module 103. The driving apparatus of the display device can be a software unit, a hardware unit, or a combination of a hardware and software unit.

The dividing module 101 is for dividing display images of one frame into detection regions. In one embodiment of the present invention, display images in one frame are divided into several detection regions. In the present embodiment, the number of the detection regions is divided according to the number of the data driving circuits. The number of rows in one detection region can be 4 lines or more than 4 lines, for example, 4 lines, 8 lines, 9 lines, 10 lines, 100 lines, or maximum lines of one frame. The number of columns in the detection regions can be the number of columns driven by the data driving circuit.

The determining module 102 is for determining the pixel polarity arrangements of each detection region; the driving module 103 is for driving the display device by selecting a corresponding scanning method according to the determined result.

As one preferred embodiment of the present invention, the determining module 102 is specifically for determining whether the detection region includes the first pixel polarity arrangement or a second pixel polarity arrangement.

In one embodiment of the present embodiment, the determining module 102 specifically comprises: a first determining module and a second determining module. The first determining module is for determining whether each of the detection regions includes the first pixel polarity arrangement, comprising steps of: presetting a first threshold voltage; if an absolute value of a voltage obtained by a voltage of row N+1 minus a voltage of row N is greater than the first threshold value, and an absolute value of the voltage obtained by the voltage of row N+1 minus a voltage of row N+2 is greater than the first threshold value, then the detection region includes the first pixel polarity arrangement.

As one embodiment of the present invention, the second determining module is for determining whether each of the detection regions includes the second pixel polarity arrangement, comprising steps of: presetting a second threshold voltage; if an absolute value of the voltage obtained by a voltage of row N+1 minus a voltage of row N is greater than the second threshold value, and an absolute value of the voltage obtained by the voltage of row N+1 minus a voltage of row N+2 is less than the second threshold value, then the detection region includes the second pixel polarity arrangement.

As another embodiment of the present invention, the second determining module is for determining whether each of the detection regions includes the second pixel polarity arrangement, comprising steps of: presetting a second threshold voltage; if an absolute value of the voltage obtained by a voltage of row N+1 minus a voltage of row N is less than the second threshold value, and an absolute value of the voltage obtained by the voltage of row N+1 minus a voltage of row N+2 is greater than the second threshold value, then the detection region includes the second pixel polarity arrangement.

As yet another embodiment of the present invention, the driving module 103 is specifically for driving the display device in a progressive scanning method when it is determined that each of the detection regions does not include the first pixel polarity arrangement; when it is determined that at least one detection region includes the first pixel polarity arrangement but the other detection regions do not include the second pixel polarity arrangement, then the data driving circuit drives the display in an interlaced scanning method; when it is determined that at least one region includes the first pixel polarity arrangement and at least one detection region includes the second pixel polarity arrangement, then the data driving circuit drives the display in an interlaced-to-progressive scanning conversion method.

There are many ways to process the interlaced scanning method, for example: 1-3-2-4-5-7-6-8 . . . ; 1-3-5-2-4-6-7-8 . . . ; 1-3-5-7-2-4-6-8 . . . , etc. However, it should be understood that the interlaced scanning method is not limited by the above. Any modification, equivalent replacement, or improvement under the spirit and principles of the present invention should be included within the protection scope of the present invention.

Furthermore, the driving module 103 is for driving the display device in the progressive scanning method when it is determined that each of the detection regions does not include the first pixel polarity arrangement, but at least one detection region includes the second pixel polarity arrangement; or for driving the display device in the progressive scanning method when it is determined that each of the detection regions does not include the first pixel polarity arrangement and the second pixel polarity arrangement.

In one embodiment of the present invention, the first pixel polarity arrangement and the second pixel polarity arrangement are different. In particular, the first pixel polarity arrangement has opposite polarity between adjacent rows; the second pixel polarity arrangement has two lines as a unit of the same polarity, adjacent units have opposite polarity.

The first pixel polarity arrangement is shown in FIGS. 4A and 4B. The pixel polarity of first row shown in FIG. 4A is positive, the pixel polarity of second row is negative, the pixel polarity of third row is positive, the pixel polarity of fourth row is negative, and so on; the pixel polarity of first row shown in FIG. 4B is negative, the pixel polarity of second row is positive, the pixel polarity of third row is negative, the pixel polarity of fourth row is positive, and so on.

The second pixel polarity arrangement is shown in FIGS. 5A and 5B, the pixel polarity of first row, the third row, and the fourth row shown in FIG. 5A are negative, the pixel polarity of fifth row and the sixth row are positive, while the pixel polarity of the seventh row and the eighth row are negative, and so on; in FIG. 5B, the pixel polarity of first row and the second row are negative, the pixel polarity of third row and the fourth row are positive, the pixel polarity of the fifth row and the sixth row are negative, the pixel polarity of seventh row and the eighth row are positive, and so on.

As mentioned in the embodiments of the present invention, firstly, the display images of one frame are divided into several detection regions, the pixel polarity arrangement of the detection region is then determined. When at least one detection region of the detection regions includes the first pixel polarity arrangement and at least one detection region includes the second pixel polarity arrangement, the data driving circuit adopts the interlaced-to-progress scanning conversion method to drive the display device; the progressive scanning method and interlaced scanning method are each held for half of the time, so as to ensure that the data driving circuits are not in a reloaded state. Thus, the power consumption of the display device can be reduced, not only can power be saved, but the heat generation can also be reduced and product durability can be improved.

It can be understood that for those skilled in the art, all or part of the steps to achieve the methods described in the above embodiments may be implemented by a program instructing relevant hardware; the program may be stored in a computer readable storage medium, such as ROM/RAM, disk, optical disk, etc.

The above are only preferred embodiments of the present invention and not intended to limit the present invention. Any modifications, equivalent replacements, improvements, and the like within the spirit and principle of the present invention shall fall within the scope of protection of the present invention.

What is claimed is:

1. A method for driving a display device comprising steps of: dividing display images of one frame into detection regions; determining pixel polarity arrangements of each detection regions; selecting a corresponding scanning method according to the determined result to drive the display device via a data driving circuit; wherein the step of determining pixel polarity arrangements of each detection regions comprises: determining whether each of the detection regions includes a first pixel polarity arrangement or a second pixel polarity arrangement; wherein the step of selecting a corresponding scanning method according to the determined result to drive the display device via a data driving circuit comprises: when it is determined that each of the detection regions does not include the first pixel polarity arrangement, then the data driving circuit drives the display device in a progressive scanning method; when it is determined that at least one detection region includes the first pixel polarity arrangement but the other detection regions do not include the second pixel polarity arrangement, then the data driving circuit drives the display device in an interlace scanning method; when it is determined that at least one detection region includes the first pixel polarity arrangement and at least one detection regions includes the second pixel polarity arrangement, then the data driving circuit drives the display in an interlaced-to-progressive scanning conversion method.

2. The method for driving a display device claimed in claim 1, wherein steps for determining whether the detection region includes the first pixel polarity arrangement are: presetting a first threshold voltage; if an absolute value of the voltage obtained by a voltage of row N+1 minus a voltage of row N is greater than the first threshold value, and an absolute value of the voltage obtained by the voltage of row N+1 minus a voltage of row N+2 is greater than the first threshold value, then the detection region includes the first pixel polarity arrangement.

3. The method for driving a display device claimed in claim 1, wherein steps for determining whether the detection region includes the second pixel polarity arrangement are: presetting a second threshold voltage; if an absolute value of the voltage obtained by a voltage of row N+1 minus a voltage of row N is greater than the second threshold value, and an absolute value of the voltage obtained by the voltage of row N+1 minus a voltage of row N+2 is less than the second threshold value, then the detection region includes the second pixel polarity arrangement.

4. The method for driving a display device claimed in claim 1, wherein the step of when it is determined that each of the detection regions does not include the first pixel polarity arrangement, then the data driving circuit drives the display device in a progressive scanning method comprises: when it is determined that each of the detection regions does not includes the first pixel polarity arrangement but at least one detection region includes the second pixel polarity arrangement, then the data driving circuit drives the display device in the progressive scanning method.

5. The method for driving a display device claimed in claim 1, wherein the first pixel polarity arrangement and the second pixel polarity arrangement are different.

6. The method for driving a display device claimed in claim 5, wherein the first pixel polarity arrangement has opposite polarity between adjacent rows;

the second pixel polarity arrangement has two lines as a unit of the same polarity, adjacent units have opposite polarity.

7. A driving apparatus of a display device comprising: a dividing module, for dividing display images of one frame into detection regions; a determining module, for determining pixel polarity arrangements of each detection regions; a driving module, for driving the display device by selecting a corresponding scanning method according to the determined result; wherein the determining module is specifically for determining whether each of the detection regions includes a first pixel polarity arrangement or a second pixel polarity arrangement; wherein the driving module is specifically for driving the display device in a progressive scanning method when it is determined that each of the detection regions does not include the first pixel polarity arrangement; when it is determined that at least one detection region includes the first pixel polarity arrangement, but the other detection regions do not include the second pixel polarity arrangement, then the data driving circuit drives the display in an interlaced scanning method; when it is determined that at least one region includes the first pixel polarity arrangement, and at least one detection region includes the second pixel polarity arrangement, then the data driving circuit drives the display in an interlaced-to-progressive scanning conversion method.

8. The driving apparatus of a display device claimed in claim 7, wherein the determining module comprises a first determining module, and a second determining module; the first determining module is for determining whether each of the detection regions includes the first pixel polarity arrangement, comprising steps of: presetting a first threshold voltage; if an absolute value of the voltage obtained by a voltage of row N+1 minus a voltage of row N is greater than the first threshold value, and an absolute value of the voltage obtained by the voltage of row N+1 minus a voltage of row N+2 is greater than the first threshold value, then the detection region includes the first pixel polarity arrangement; the second determining module is for determining whether each of the detection regions includes the second pixel polarity arrangement, comprising steps of: presetting a second threshold voltage; if an absolute value of voltage obtained by a voltage of row N+1 minus a voltage of row N is greater than the second threshold value, and an absolute value of voltage obtained by the voltage of row N+1 minus a voltage of row N+2 is less than the second threshold value, then the detection region includes the second pixel polarity arrangement.

9. The driving apparatus of a display device claimed in claim 7, wherein the driving module is further for driving the display device in the progressive scanning method when it is determined that each of the detection regions does not include the first pixel polarity arrangement, but at least one detection region includes the second pixel polarity arrangement.

10. A method for driving a display device comprising steps of:

dividing display images of one frame into detection regions;

determining whether each of the detection regions includes a first pixel polarity arrangement or a second pixel polarity arrangement; wherein, the first pixel polarity arrangement and the second pixel polarity arrangement are different;

when it is determined that each of the detection regions does not include the first pixel polarity arrangement, then a data driving circuit drives the display device in a progressive scanning method;

when it is determined that at least one detection region includes the first pixel polarity arrangement but the other detection regions do not include the second pixel polarity arrangement, then the data driving circuit drives the display device in an interlaced scanning method;

when it is determined that at least one detection region includes the first pixel polarity arrangement and at least one detection regions includes the second pixel polarity arrangement, then the data driving circuit drives the display in an interlaced-to-progressive scanning conversion method.

11. The method for driving a display device claimed in claim 10, wherein steps for determining whether the detection region includes the first pixel polarity arrangement are:

presetting a first threshold voltage;

if an absolute value of a voltage obtained by a voltage of row N+1 minus a voltage of row N is greater than the first threshold value, and an absolute value of a voltage obtained by the voltage of row N+1 minus a voltage of row N+2 is greater than the first threshold value, then the detection region includes the first pixel polarity arrangement.

12. The method for driving a display device claimed in claim 10, wherein steps for determining whether the detection region includes the second pixel polarity arrangement are:

presetting a second threshold voltage;

if an absolute value of a voltage obtained by a voltage of row N+1 minus a voltage of row N is greater than the second threshold value, and an absolute value of a voltage obtained by the voltage of row N+1 minus a voltage of row N+2 is less than the second threshold value, then the detection region includes the second pixel polarity arrangement.

13. The method for driving a display device claimed in claim 10, wherein the step of when it is determined that each of the detection regions does not include the first pixel polarity arrangement, then a data driving circuit drives the display device in a progressive scanning method comprises:

when it is determined that each of the detection regions does not includes the first pixel polarity arrangement, but at least one detection region includes the second pixel polarity arrangement, then the data driving circuit drives the display device in the progressive scanning method.

14. The method for driving a display device claimed in claim 10, wherein the first pixel polarity arrangement has opposite polarity between adjacent rows;

the second pixel polarity arrangement has two lines as a unit of the same polarity, adjacent units have opposite polarity.

15. The method for driving a display device claimed in claim 10, wherein steps for determining whether the detection region includes the second pixel polarity arrangement are:

presetting a second threshold voltage;

if an absolute value of a voltage obtained by a voltage of row N+1 minus a voltage of row N is less than the second threshold value, and an absolute value of the voltage obtained by the voltage of row N+1 minus a voltage of row N+2 is greater than the second threshold value, then the detection region includes the second pixel polarity arrangement.

16. The method for driving a display device claimed in claim 10, wherein the step of when it is determined that each of the detection regions does not include the first pixel polarity arrangement, then a data driving circuit drives the display device in a progressive scanning method comprises:

when it is determined that each of the detection regions does not includes the first pixel polarity arrangement and the second pixel polarity arrangement, then the data driving circuit drives the display device in the progressive scanning method.

* * * * *